US011557840B2

(12) United States Patent
Gimersky

(10) Patent No.: US 11,557,840 B2
(45) Date of Patent: Jan. 17, 2023

(54) HIGH-PERFORMANCE DUAL-POLARIZED ANTENNA FEED CHAIN

(71) Applicant: VIASAT, INC., Carlsbad, CA (US)

(72) Inventor: Martin Gimersky, Morges (CH)

(73) Assignee: VIASAT, INC., Carlsbad, CA (US)

( * ) Notice: Subject to any disclaimer, the term of this patent is extended or adjusted under 35 U.S.C. 154(b) by 0 days.

(21) Appl. No.: 17/273,185

(22) PCT Filed: Sep. 6, 2019

(86) PCT No.: PCT/US2019/049963
§ 371 (c)(1),
(2) Date: Mar. 3, 2021

(87) PCT Pub. No.: WO2020/051459
PCT Pub. Date: Mar. 12, 2020

(65) Prior Publication Data
US 2021/0305707 A1 Sep. 30, 2021

Related U.S. Application Data

(60) Provisional application No. 62/727,841, filed on Sep. 6, 2018.

(51) Int. Cl.
*H01Q 13/02* (2006.01)
*H01P 1/161* (2006.01)
*H01Q 19/08* (2006.01)

(52) U.S. Cl.
CPC ..... *H01Q 13/0208* (2013.01); *H01P 1/161* (2013.01); *H01Q 19/08* (2013.01)

(58) Field of Classification Search
CPC ..... H01Q 13/0208; H01Q 13/0258; H01Q 19/08; H01Q 19/10; H01P 1/161
See application file for complete search history.

(56) References Cited

U.S. PATENT DOCUMENTS 7,239,285 B2 7/2007 Cook
2002/0011960 A1 1/2002 Yuanzhu

FOREIGN PATENT DOCUMENTS

EP 1406350 A2 * 4/2004 ..... H01Q 13/0208

OTHER PUBLICATIONS

International Search Report and Written Opinion issued in International Application No. PCT/US2019/049963 dated Nov. 29, 2019, in 9 pages.
Varela, et al., "Circularly Polarized C-Band Lens-Horn Antenna for Radar Remote Sensing Calibration", 2nd URSI AT-RASC, Gran Canaria, May 28-Jun. 1, 2018, 4 pages.

* cited by examiner

*Primary Examiner* — Hoang V Nguyen
(74) *Attorney, Agent, or Firm* — F. Chau & Associates, LLC

(57) ABSTRACT

Antenna feed chains and methods are disclosed. An antenna feed chain, include a feed horn having a first cross-polarization performance over a solid angle of interest and a frequency band of interest and a polarizer having a second cross-polarization performance over the solid angle of interest and the frequency band of interest. The polarizer is coupled to the feed horn. The first cross-polarization performance of the feed horn compensates for the second cross-polarization performance of the polarizer over the solid angle of interest and the frequency band of interest.

18 Claims, 8 Drawing Sheets

HIGH-PERFORMANCE DUAL-POLARIZED ANTENNA FEED CHAIN

CROSS-REFERENCE TO RELATED APPLICATIONS

This application is a U.S. National Stage entry of PCT Application No. PCT/US2019/049963, filed on Sep. 6, 2019, which claims priority from U.S. Provisional Application No. 62/727,841, filed Sep. 6, 2018, the contents of which are incorporated herein by reference in their entirety.

FIELD OF INVENTION

The present disclosure relates generally to antennas, and more specifically to antenna feed chains.

BACKGROUND

Various RF antennas may be suitable for transmitting, receiving, or transmitting and receiving a signal. RF antennas may include a feed horn and a polarizer. A feed horn and a polarizer comprise an antenna feed chain. Generally, the cross-polarization performance of an antenna feed chain may impact the antennas performance. Antenna performance may impact the performance of a communication system using the antenna. Accordingly, antenna performance may impact the ability of a communication to successfully send, successfully receive, or successfully send and receive signals. Thus, it may be beneficial to improve cross-polarization performance in an antenna feed chain.

SUMMARY

In an example embodiment, an antenna feed chain includes a feed horn having a first cross-polarization performance over a solid angle of interest and a frequency band of interest. The antenna feed chain includes a polarizer having a second cross-polarization performance over the frequency band of interest. The polarizer is coupled to the feed horn. The first cross-polarization performance of the feed horn compensates for the second cross-polarization performance of the polarizer over the solid angle of interest and the frequency band of interest.

In an example embodiment, a method of designing an antenna feed chain includes determining an initial design for each of a feed horn having a first cross-polarization performance and a polarizer having a second cross-polarization performance. The method also includes using the first cross-polarization performance of the feed horn to compensate for the second cross-polarization performance of the polarizer over a frequency band of interest. Additionally, the method includes coupling the feed horn to the polarizer to form the antenna feed chain.

In an example embodiment, an antenna feed chain includes a feed horn and a polarizer coupled to the feed horn. The feed horn has a cross-polarization performance over an angle of interest and a frequency band of interest (CP performance) that is worse than a reference feed horn CP performance of a reference feed horn (of the same kind, aperture diameter, and length as the feed horn). The antenna feed chain nonetheless has a CP performance that is better than a reference antenna feed chain CP performance of a reference antenna feed chain comprising the reference feed horn and the polarizer.

BRIEF DESCRIPTION OF THE DRAWING FIGURES

Additional aspects of the present invention will become evident upon reviewing the non-limiting embodiments described in the specification and the claims taken in conjunction with the accompanying figures, wherein like numerals designate like elements, and:

DETAILED DESCRIPTION

Figure 1:
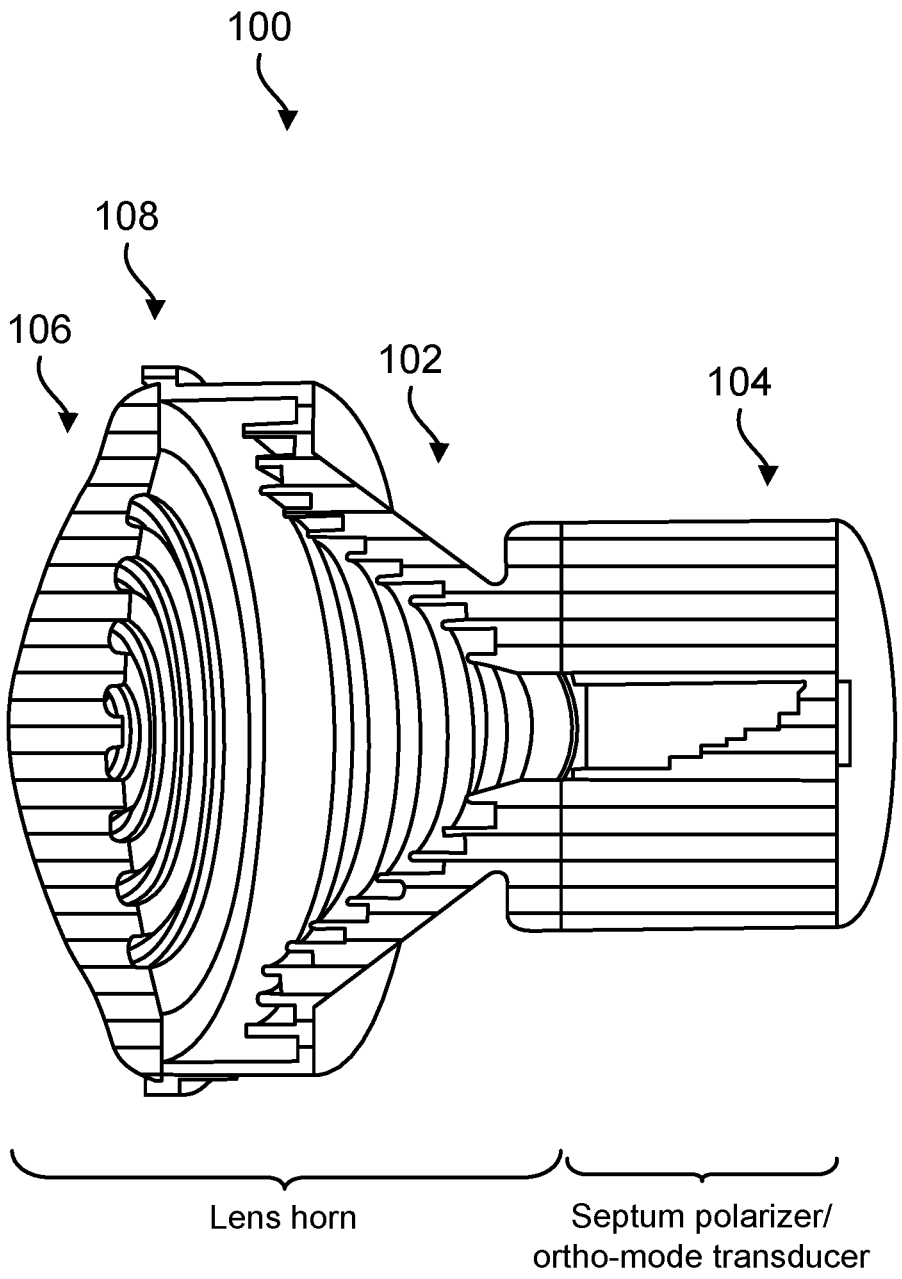
FIG. 1 is a diagram illustrating an example of an antenna feed chain as described herein.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As described above, various RF antennas may be suitable for transmitting, receiving, or transmitting and receiving a signal. An antenna feed chain may include a feed horn and a polarizer. The feed horn and the polarizer may each have a cross-polarization performance. Furthermore, a combination of the feed horn and the polarizer may have a cross-polarization performance. Typically, a feed horn may be designed to maximize a performance characteristic such as cross-polarization performance. Additionally, a polarizer may be designed to maximize a performance characteristic such as cross-polarization performance. The feed horn and the polarizer may then be coupled together to form an antenna feed chain. However, such a combination may generally not provide for the best performance of the feed chain, i.e., as defined by the chosen performance characteristic, e.g., cross-polarization performance. Rather, independently "optimizing" the design of the each component may result in, for example, the poorest performance of each component occurring at or near the same frequencies. Accordingly, frequency ranges with poor performance may have those poor performances add together to provide degraded performance for the combined device at those frequencies.

Generally, poor cross-polarization performance of an antenna feed chain may impact the antenna's performance. Antenna performance may impact the performance of a communication system using the antenna. Accordingly, antenna performance may impact the ability of a communication to successfully send, successfully receive, or successfully send and receive signals. Thus, it may be beneficial to improve cross-polarization performance in an antenna feed chain.

As described above, an antenna feed chain may provide improved performance over a wide bandwidth. In an example embodiment, a feed horn of an antenna feed chain may be designed to compensate for the performance of a polarizer of the feed chain. An antenna feed chain includes a feed horn having a first cross-polarization performance over a solid angle of interest and a frequency band of interest. In an example embodiment, a solid angle is a measure of the amount of the field of view from some particular point that a given object covers. That is, the solid angle may be a measure of how large the object appears to an observer looking from that point, i.e., the apex. The antenna feed chain also includes a polarizer having a second cross-polarization performance over the frequency band of interest. The polarizer is coupled to the feed horn. The first cross-polarization performance of the feed horn compensates for the second cross-polarization performance of the polarizer over the solid angle of interest and the frequency band of interest.

In another example embodiment, a polarizer of an antenna feed chain may be designed to compensate for the performance of a feed horn of the feed chain. Generally, the design of the feed horn and the design of the polarizer interact such that performance of the feed chain may be set by the combination of each design. Thus, the design of the feed horn may compensate for the performance of a polarizer and the design of the polarizer may compensate for the performance of a feed horn. Accordingly, designing a feed horn to compensate for a polarizer may include designing a polarizer to compensate for a feed horn. Designing a polarizer to compensate for a feed horn may include designing a feed horn to compensate for a polarizer. Additionally, in an example embodiment, designing a feed horn to compensate for a polarizer and/or designing a polarizer to compensate for a feed horn may include iteratively modifying one or more of the feed horn and or the polarizer.

In an example embodiment, the feed horn may be designed such that cross-polarization performance of the feed horn may be higher at frequencies where the cross-polarization performance of the polarizer is lower. The feed horn may be designed such that the cross-polarization performance of the feed horn may be lower at frequencies where the cross-polarization performance of the polarizer is higher. Accordingly, the cross-polarization performance of the feed chain may be improved, e.g., over frequencies and/or phases of interest. Thus, the cross-polarization performance of the antenna feed chain may be "collectively" maximized over the operating frequency band(s) of the antenna by leveling out the cross-polarization performance across the operating frequency band(s).

Collectively maximizing the feed chain as a whole may result in improved performance of the antenna feed chain as compared to independently "optimizing" the design of each component. Independently "optimizing" the design of each component may result in poorer performance of each component occurring at or near the same frequencies. Poor performance may add together to provide degraded performance at those frequencies.

As used herein, the maximum of the performance metric denotes a relative maximum value over the operating frequency band(s) of the antenna or an individual component. The performance metric may vary from embodiment to embodiment. As used herein, "performance metric" refers to any metric for which a higher value indicates better performance. In some embodiments, the maximum of the "performance metric" is achieved by minimizing a parameter for which a lower value indicates better performance. For example, the maximum cross-polarization performance is achieved by minimizing cross-polarization. Examples are described herein that use cross-polarization performance as the performance metric. Other possible performance metrics include, but are not limited to return loss, port-to-port isolation, axial ratio, higher-order mode suppression, and/or radiation characteristics such as, peak co-polarized gain, sidelobe level suppression, beam shape, minimum cross-polarized radiation within a solid angle or other radiation characteristics.

FIG. 1 is a diagram illustrating an example of an antenna feed chain 100 as described herein. The example antenna feed chain 100 includes a feed horn 102 (also referred to as a "horn" herein) and a polarizer 104. In the example of FIG. 1, the feed horn 102 includes a lens 106. Accordingly, the feed horn 102 may be a lens horn 108. Additionally, in the example of FIG. 1, the polarizer 104 may be a septum polarizer ortho-mode transducer (SP/OMT). The feed horn 102 may include an aperture at a first end and a second end opposite the first end. The polarizer 104 may include a first end and a second end. The second end of the feed horn 102 is connected to the first end of the polarizer 104 for passing signals between the aperture of the feed horn and an input/output at the second end of the polarizer. In an example embodiment, a waveguide is provided coupling the feed horn to the polarizer, the waveguide may be terminated at the feed horn and may be configured to have cross-sectional dimensions to predominantly propagate a dominant field mode. Accordingly, the systems and methods described herein may help eliminate unneeded or unwanted modes in favor of a dominant field mode. Furthermore, in an example embodiment, a reflector (not shown) may be configured to reflect signals from the feed horn 102.

In an example embodiment, an antenna feed chain 100 may include a feed horn 102 having a first cross-polarization performance over a solid angle of interest and a frequency band of interest. The antenna feed chain 100 may also include a polarizer 104 having a second cross-polarization performance over the frequency band of interest. The polarizer may be coupled to the feed horn. The first cross-polarization performance of the feed horn may compensate for the second cross-polarization performance of the polarizer over the solid angle of interest and the frequency band of interest.

Furthermore, while in the example of FIG. 1, the antenna feed chain 100 includes the lens horn 108 and the SP/OMT, the systems and methods described herein may be applied to any horn and any polarizer. For example, the feed horn may a pyramidal horn, a sectoral horn, an E-plane horn, an H-plane horn, a sectoral horn flared in the direction of the magnetic or H-field in a waveguide, a conical horn, an exponential horn, a corrugated horn, a dual-mode conical horn, a diagonal horn, a ridged horn, a septum horn, or aperture-limited horn, to name a few examples. In an example embodiment, when the feed horn is corrugated, the feed horn may be axial corrugated or otherwise corrugated. The feed horn may include at least one of a smoothly flared horn, a discontinuous flared horn, or a combination of the smoothly flared horn and the discontinuous flared horn.

The polarizer 104 may be a linear polarizer, an absorptive polarizer, a beam-splitting polarizer, or another polarizer. In an example embodiment, the polarizer may be a septum polarizer. The feed horn in the example of FIG. 1 includes a lens and an axially-corrugated horn. In other embodiments, the antenna feed chain may be different.

In an example embodiment, the lens 106 may be omitted. However, the lens 106 may be useful, particularly in situations where the application would otherwise necessitate a physically large standalone horn. In such circumstances, the lens horn may achieve desired RF characteristics, such as peak gain, of the standalone horn in an appreciably smaller volume. For example, a feed horn of a modest size provides a portion of the desired gain, and a lens, located in, or near, the feed horn aperture provides the remaining part of the desired gain.

In an example embodiment, design modifications of the lens 106 or lens horn 108 may be preferable to design modifications of the polarizer 104. Design modifications of the lens 106 or lens horn 108 may be preferable to design modifications of the polarizer 104 because of the extra degrees of freedom in the design of the lens 106 or lens horn 108.

Furthermore, a lens horn 108 may be preferable to a standalone feed horn 102. The lens horn 108 may be preferable to a standalone feed horn 102 because of the extra degrees of freedom and more dimensions of the design space, that the lens horn 108 offers in comparison with the standalone feed horn 102. In addition to the feed horn 102, the lens 106 brings in the lens' two surfaces. The surfaces may be shaped toward achieving performance characteristics that a standalone feed horn 102 may have difficulty achieving, e.g., the lens may be used to form the shape of the main lobe beyond what is feasible with the standalone feed horn 102.

In the example of FIG. 1, the antenna feed chain includes the septum polarizer/ortho-mode transducer (SP/OMT) (polarizer 104). In other embodiments, the type of polarizer may be different and may include a dedicated OMT. In some embodiments, the SP/OMT (polarizer 104) may provide the following benefits, such as component simplicity. The SP/OMT may provide the functionality of a polarizer and an OMT in a single device. Other combinations of a dedicated polarizer and a dedicated OMT may be more complex, bulkier, heavier and considerably more expensive to mass-produce, in some examples.

Some examples may be amenable to mass production at a low cost. The SP/OMT housings may be produced by die casting in split block, and the septa may be stamped from sheet metal in some examples.

The SP/OMT (polarizer 104) may have some limitations due to wave propagation in waveguides, however. For example, the two dominant modes in the square waveguide, $TE_{10}$, and $TE_{01}$, may have the same cutoff frequency, $f_{c1}$. The first higher-order modes are $TE_{11}$ and $TM_{11}$, and their cutoff frequency, $f_{c2}$, is related to $f_{c1}$ as $$f_{c2}=f_{c1}\cdot\sqrt{2}$$

That is, the relative bandwidth between the cutoff of $TE_{10}/TE_{01}$ and the cutoff of $TE_{11}/TM_{11}$ is $$\frac{\sqrt{2}-1}{(\sqrt{2}+1)/2}=34.3\%$$

Near $f_{c1}$, the waveguide attenuation approaches infinity. The commonly accepted practice is to operate waveguides at a frequency that may be at least 15% above the cutoff frequency. Consequently, the theoretical relative bandwidth of the square waveguide and, by extension, the septum polarizer in the square waveguide operating with dominant modes is $$\frac{\sqrt{2}-1.15}{(\sqrt{2}+1.15)/2}=20.6\%$$

A practically achievable relative bandwidth for the septum polarizer in the square waveguide operating with dominant modes only is about 15%. (The relative bandwidth of the septum polarizer in the circular waveguide operating with dominant modes only is even smaller.) In comparison, for an application operating in the extended $K_a$ frequency bands of 17.3-21.2 GHz and 27.5-31.0 GHz, the composite bandwidth of 17.3-31.0 GHz corresponds to a relative bandwidth of 56.7%. A composite bandwidth corresponding to a relative bandwidth of 56.7% implies that the excitation of higher-order modes in the SP/OMT may be inevitable above the 17.3-21.2 GHz band.

Figure 2:
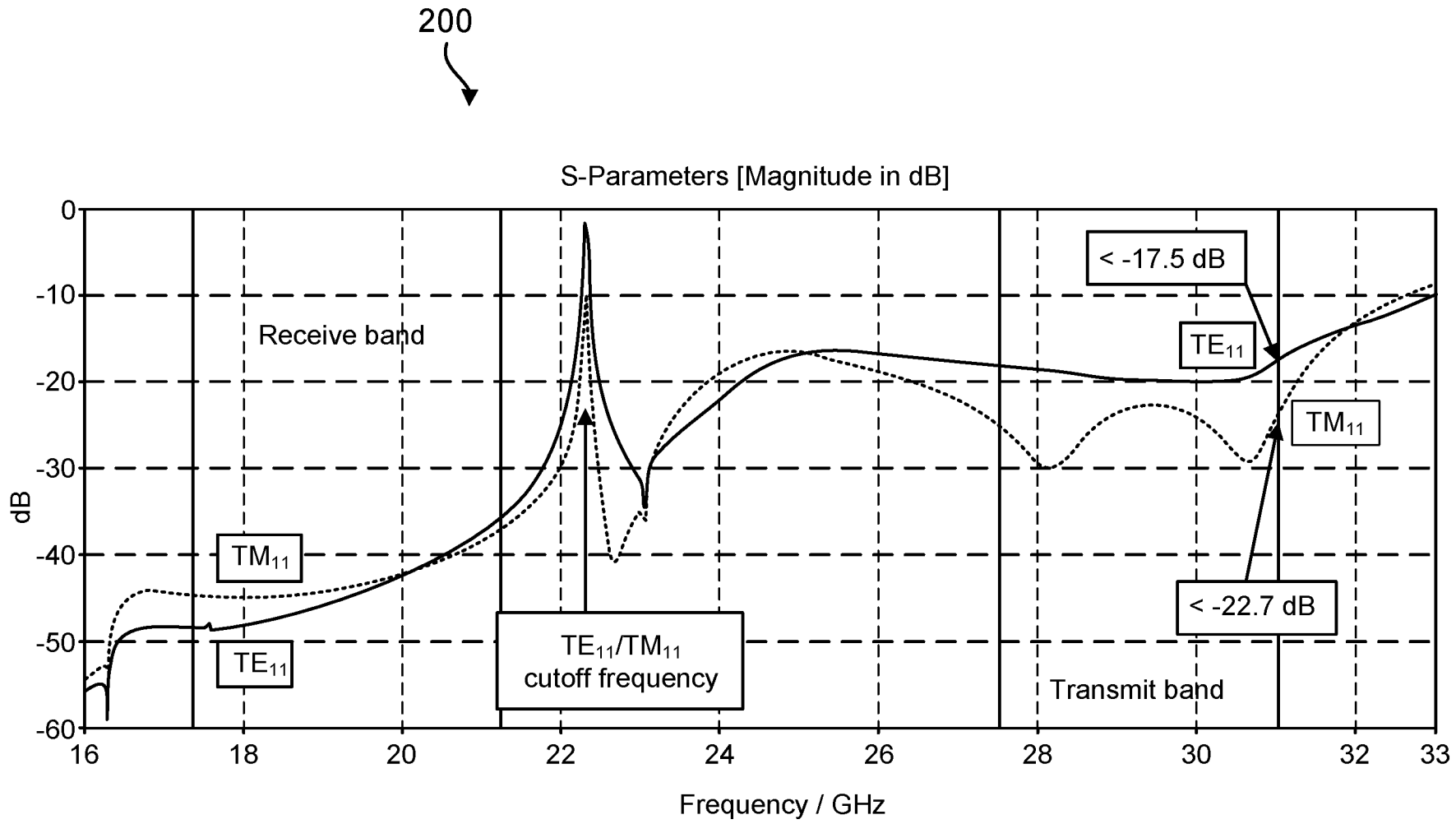
FIG. 2 is a diagram illustrating an example of computed excitation levels of higher-order modes in an example septum polarizer/OMT.

FIG. 2 is a diagram 200 illustrating an example of computed excitation levels of higher-order modes in an example septum polarizer/OMT (polarizer 104). Frequency, in GHz runs along the x-axis. Magnitude of S-parameters in dB run along the y-axis. TM11 (dashed line) and TE11 (solid line) are illustrated. The cutoff frequency for TE11 and TM11 is noted as well as the receive band and the transmit band for an example communication.

The space segment of a $K_a$-band satellite communication systems transmits in the lower (17.7-21.2 or 17.3-21.2 GHz) frequency band and receives in the higher (27.5-31.0 GHz) frequency band. In the ground segment, the frequency allocation may be opposite. The regulatory requirements on the operation of satellite communication systems apply to the transmit functionality, with the goal of ensuring that one piece of equipment does not interfere with another piece of equipment. The goal of ensuring that equipment does not interfere means that the ground segment equipment may be particularly adversely affected by the excitation of higher-order modes in the ground segment equipment's SP/OMT's in the transmit band.

The electromagnetic field distributions of the $TE_{11}$ and $TM_{11}$ modes in the square waveguide compared to those of the $TE_{10}$ and $TE_{01}$ modes are such that the excitation of the higher-order modes in the SP/OMT increases the cross-polarized field components of the device, and hence also the overall feed chain. Increasing the cross-polarized field components of the device and hence also the overall feed chain may make it more difficult to achieve adequate cross-polarized radiation performance in the ground segment feed chains and overall antenna systems. Specifically, the regulators, for reasons of avoiding interference with other satellite operators, may set limits for the off-boresight cross-polarized radiation of antennas, and the interference-free operation of one's own satellite may dictate a limit on the cross-polarized radiation at the antenna boresight. Accordingly, limiting the cross-polarized radiation of ground segment satellite communication antennas is particularly important.

Waveguides are generally operated with dominant modes only. That is, cross-sectional dimensions of the waveguide are chosen such that only the dominant field mode, e.g., $TE_{10}$ or $TE_{11}$ in the rectangular or circular waveguide, respectively, may propagate in the waveguide in a desired operating frequency band, e.g., the waveguide's cross-sectional dimensions are too small for supporting propagation of higher-order modes.

When a waveguide is required to radiate to free space or illuminate a reflector, for example, while providing a larger peak gain than that of the open-ended waveguide, the waveguide is terminated with a feed horn (e.g., feed horn 102 of FIG. 1). The feed horn is a waveguiding structure that flares out to an aperture that is sized to provide a required peak gain. As the electromagnetic wave propagating in the feeding waveguide enters the feed horn structure and the feed horn flares open—either gradually (smoothly) or in steps (discontinuities) or combinations thereof—the increased cross-section of the feed horn enables the generation of higher-order field modes in the feed horn. In the case of a circular waveguide feeding a rotationally-symmetric horn, the modes listed in Table 1 get excited in the feed horn, depending on the diameter of the feed horn's radiating aperture. Exciting the modes of Table 1 in the feed horn as described above, at a point along the feed horn where the feed horn's diameter is 2.5 wavelengths, for example, the $TM_{11}$, $TE_{12}$, and $TM_{12}$ modes are excited in addition to the dominant ($TE_{11}$) mode, since the cut-off guide diameter of these modes is smaller than 2.5 wavelengths.

TABLE 1

Dominant and higher-order modes in circular waveguide

| Mode | Cut-off guide diameter [wavelength] |
|---|---|
| $TE_{11}$ | 0.5861 |
| $TM_{11}$ | 1.2197 |
| $TE_{12}$ | 1.6971 |
| $TM_{12}$ | 2.2331 |
| $TE_{13}$ | 2.7172 |
| $TM_{13}$ | 3.2383 |
| $TE_{14}$ | 3.7261 |
| $TM_{14}$ | 4.2411 |
| $TE_{15}$ | 4.7312 |
| $TM_{15}$ | 5.2428 |
| $TE_{16}$ | 5.7345 |

Table 1 is a table of dominant and higher-order modes in circular waveguides. Because cut-off guide diameter increases with the mode order, the excitation amplitudes and phases of the higher-order modes in the feed horn may be controlled by shaping the inside profile of the feed horn. When, for example, a higher content of a field mode is desired in the radiating aperture of the feed horn, the feed horn may be shaped to (1) increase the excitation amplitude of the mode in the feed horn and (2) guide the mode to the radiating aperture (as opposed to trapping the mode by preventing the mode from propagating or converting the mode to another farther down the length of the feed horn). Conversely, the excitation amplitude of a mode that is not wanted in the feed horn aperture may be minimized by reshaping the feed horn profile.

As described herein, although the concept was illustrated on an example of the rotationally-symmetric horn, the concept is generally valid for all kinds of horns.

A feed chain may include a polarizer and a feed horn, and the feed chain may be designed the following way:

In a step [A1], the polarizer may be designed for the desired, or best possible, performance in terms of one or more of: (1) return loss, (2) port-to-port isolation, (3) axial ratio, and/or (4) higher-order mode suppression, e.g., in the case of a polarizer that operates with more modes than just the two fundamental ones.

In a step [A2], the feed horn may be designed for the desired or best possible performance in terms of one or more of: (1) return loss and/or radiation characteristics such as: (a) peak co-polarized gain, (b) sidelobe level suppression, (c) beam shape, (d) maximum cross-polarized radiation within a solid angle, and/or other indication of performance.

In a step [A3], the polarizer of [A1] may be cascaded with the feed horn of [A2]. In other words, the polarizer and the feed horn may be coupled together.

In an optional step [A4], the length of the waveguide section between the septum of the polarizer and the feed horn may be fine-tuned for the best overall performance of the assembly (e.g., antenna feed chain).

Figure 3:
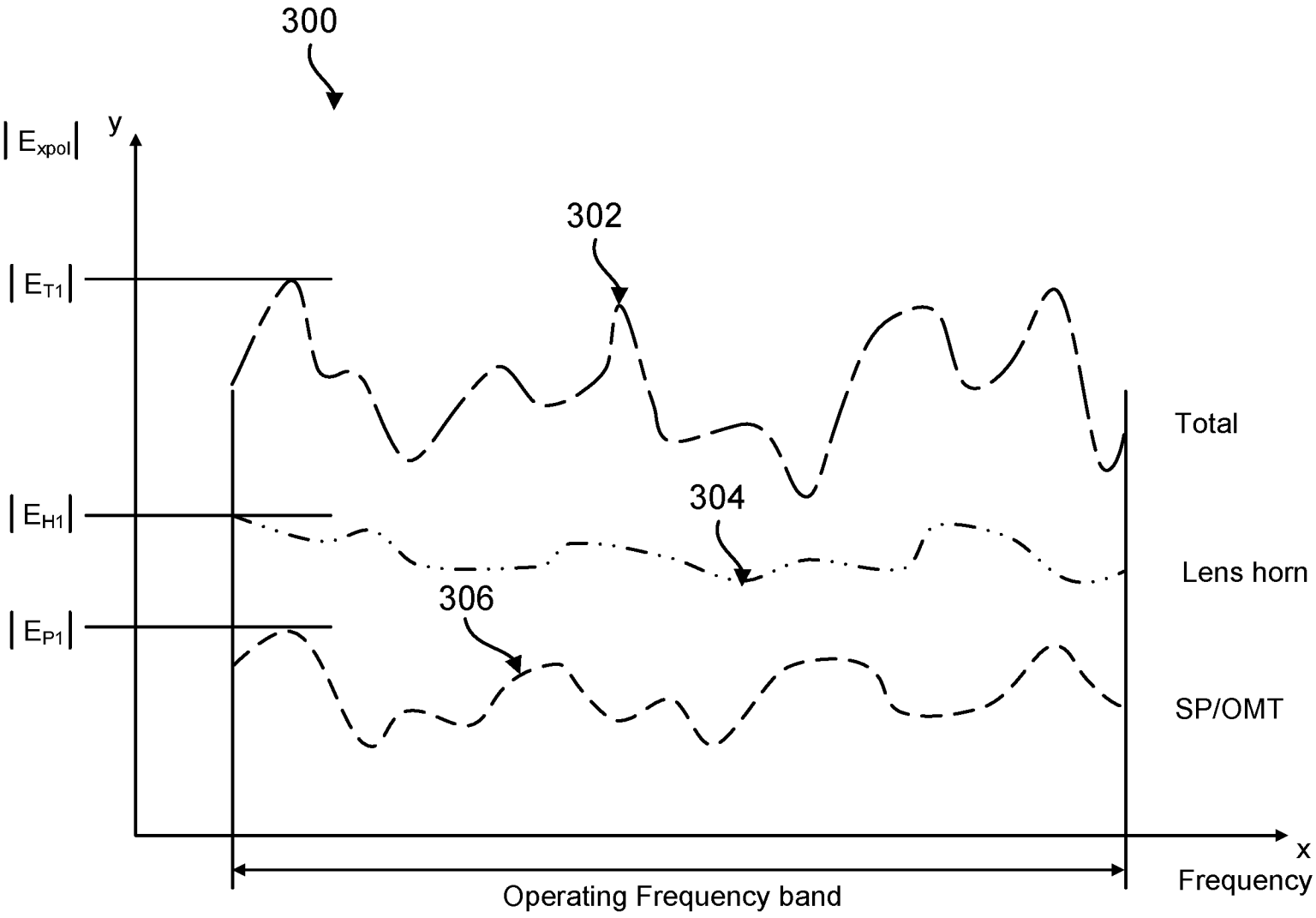
FIG. 3 is a diagram illustrating an example amplitude of cross-polarized radiation of a conventionally designed feed chain.

FIG. 3 is a diagram 300 illustrating an example amplitude of cross-polarized radiation of a conventionally designed feed chain. Frequency runs along the x-axis. Amplitude of the cross-polarized radiation runs along the y-axis. The amplitude of the cross-polarized radiation, such as the maximum cross-polarized radiation within a solid angle of interest (which, for example, may correspond to the illumination cone of a reflector that the feed chain illuminates), of the feed chain designed conventionally may look like that illustrated in FIG. 3. In FIG. 3, the total cross-polarized radiation (dashed line) 302 includes two contributions: the cross-polarized radiation of the polarizer (dashed line) 306 and the cross-polarized radiation of the feed horn (dash-dotted line) 304. The total cross-polarized radiation 302 of the feed chain results from the vector addition of the two contributions.

In contrast, in some example embodiments, the feed horn 102, as described herein may be designed the following way:

Step [B1] may be the same as step [A1].

Step [B2] may be the same as [A2].

Step [B3] may be the same as [A3]. As illustrated in FIG. 1, the polarizer 104 may be a septum polarizer ortho-mode transducer. As illustrated in FIG. 1, the feed horn 102 may be lens horn 108.

In a step [B4], the feed horn 102 may be optimized in the full feed chain (antenna feed chain 100 of FIG. 1) arrangement, e.g., including the imperfect polarizer 104. For example, an antenna feed chain 100 may include a feed horn 102 having a first cross-polarization performance over a solid angle of interest and a frequency band of interest. The antenna feed chain 100 may also include a polarizer 104 having a second cross-polarization performance over the frequency band of interest. The polarizer may be coupled to the feed horn. The first cross-polarization performance of the feed horn may compensate for the second cross-polarization performance of the polarizer over the solid angle of interest and the frequency band of interest.

Specifically, in an example embodiment, the compensation may be due to changing (1) the shapes of the lens surfaces, (2) the position of the lens, and/or (3) all, or a subset of, dimensions of the feed horn. Any or all of these physical changes may help optimize or improve the cross-polarization performance of the full feed chain. The purpose of the optimization/compensation-changes may be to distribute the cross-polarization properties of the feed horn 102 unevenly across the operating frequency bands, so that the feed horn 102 vector-adds only minimal cross-polarized radiation at the frequencies where the polarizer 104 is the least polarization-clean, e.g., has the lowest polarization performance (may be a relative or local low) at the price of vector-adding more cross-polarized radiation at the frequencies where the polarizer 104 is the most polarization-clean, e.g., has the highest polarization performance (may be a relative or local high). The design process may yield an antenna feed chain 100 with a fairly leveled cross-polarization performance across the operating frequency bands of the antenna. (See FIGS. 4 and 5)

Figure 4:
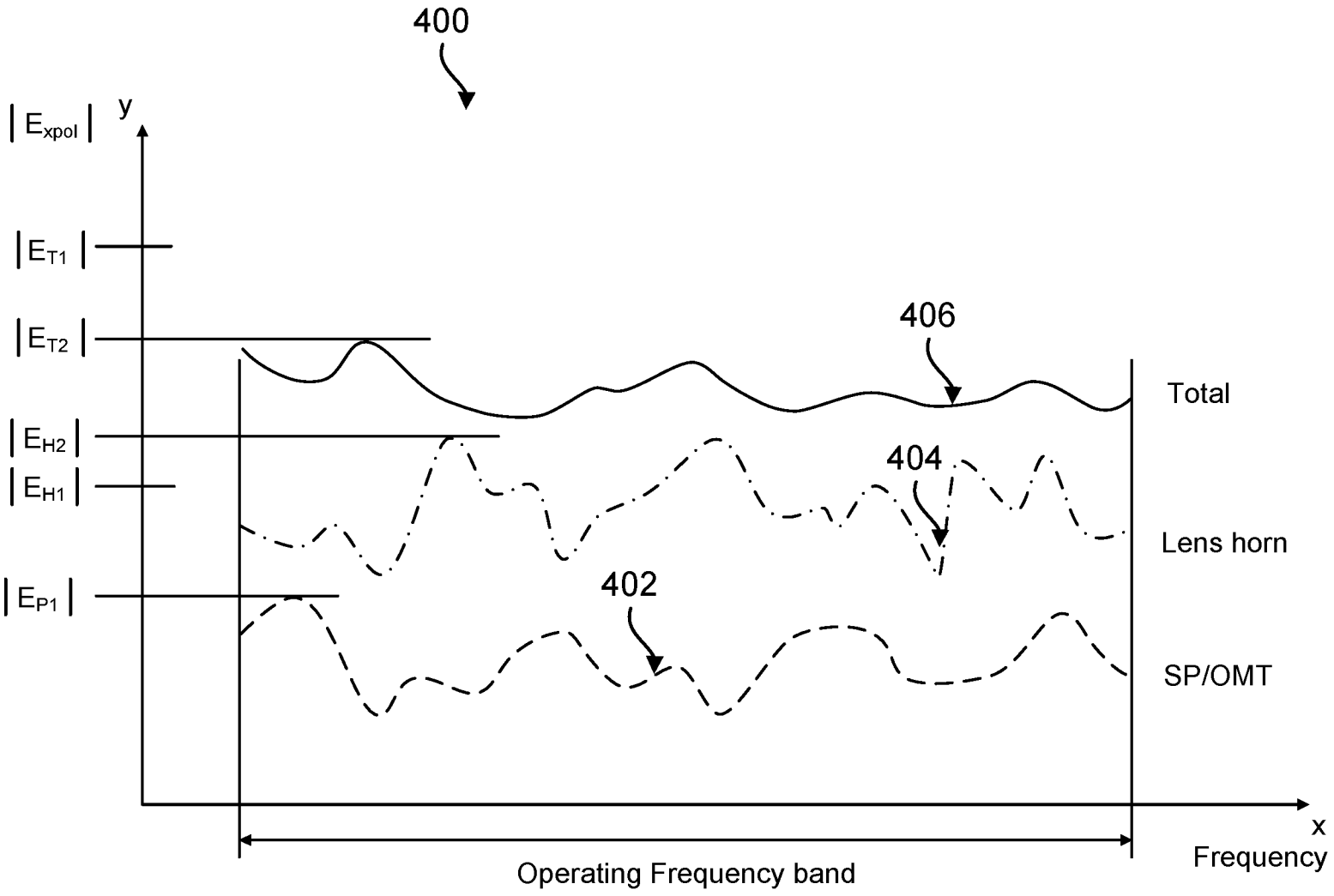
FIG. 4 is a diagram illustrating an example amplitude of cross-polarized radiation of a feed chain designed according to the systems and methods described herein.

FIG. 4 is a diagram 400 illustrating an example amplitude of cross-polarized radiation of a feed chain designed according to the systems and methods described herein. Frequency runs along the x-axis. Amplitude of the cross-polarized radiation runs along the y-axis. As illustrated in FIG. 4, the amplitude of cross-polarized radiation (e.g., maximum cross-polarized radiation within an illumination cone of reflector) of a feed chain 100 may include the vector summation of the cross-polarized contribution from polarizer 104 (see dashed line 402) plus the cross-polarized contribution from the feed horn 102 (see dash-dot line 404). The total cross-polarized radiation of the feed chain 100 may be represented by solid line 406.

An example "fairly leveled" cross-polarization is illustrated in FIG. 4. In FIG. 4, the cross-polarized radiation from the polarizer 104 may be the same as that in FIG. 3. (Although in some embodiments, the polarizer 104 may be optimized relative to the feed chain.) Because the feed horn 102 may be synthesized differently than the conventional design, the cross-polarized radiation produced by the feed horn 102 may differ from that in FIG. 3.

The cross-polarized radiation produced by the feed horn 102 may feature higher local maxima ($|E_{H2}|>|E_{H1}|$) and lower local minima than that in FIG. 3. However, the maximum amplitude of the total cross-polarized radiation of the feed chain may be lower ($|E_{T2}|<|E_{T1}|$).

In an example embodiment, the amplitude may be more leveled than that in FIG. 3. For example, the difference between the highest cross-polarization value and the lowest cross-polarization value over the operating frequency band may be smaller. Alternatively, the standard deviation for the cross-polarization values over the operating frequency band of the solid angle of interest may be lower.

The feed horn 102 synthesized according to the principles of the present disclosure may include (1) manipulating the amplitudes and phases of the field modes excited and guided in the lens horn and (2) exploiting the property of vector addition to lower the amplitude of the total cross-polarized radiation when two vectors are out of phase or close to out of phase.

In the processes of optimization, transmit-band performance of the feed chain may be given carefully chosen priority over performance in the receive band. The goal of such optimization is to produce a feed chain design that leads to an antenna that is compliant with regulatory requirements, which apply only in the transmit band, yet has adequate RF performance also in the receive band.

In other example embodiments, the design process may be different than the example steps described above. For example, in one alternative example embodiment, the step [B4] may include that the feed horn 102 and the polarizer 104 may both be optimized in the full feed chain arrangement, i.e., including the polarizer. Specifically, one or more of the following features may be modified to change the characteristics of the polarizer: (1) the shapes of the lens surfaces, (2) the position of the lens, (3) all, or a judiciously chosen subset of, dimensions of the feed horn, and (4) all, or a judiciously chosen subset of, dimensions of the polarizer may then be optimized in the full feed chain arrangement. The purpose of the optimization (or design modifications) may be to distribute the cross-polarization properties of the lens horn 108 unevenly across the operating frequency bands, so that the lens horn 108 adds only minimal cross-polarized radiation at the frequencies where the polarizer is the least polarization-clean, at the price of adding more cross-polarized radiation at the frequencies where the polarizer is the most polarization-clean. The design process may yield a feed chain with fairly level cross-polarization performance across the operating frequency bands of the antenna.

Figure 5:
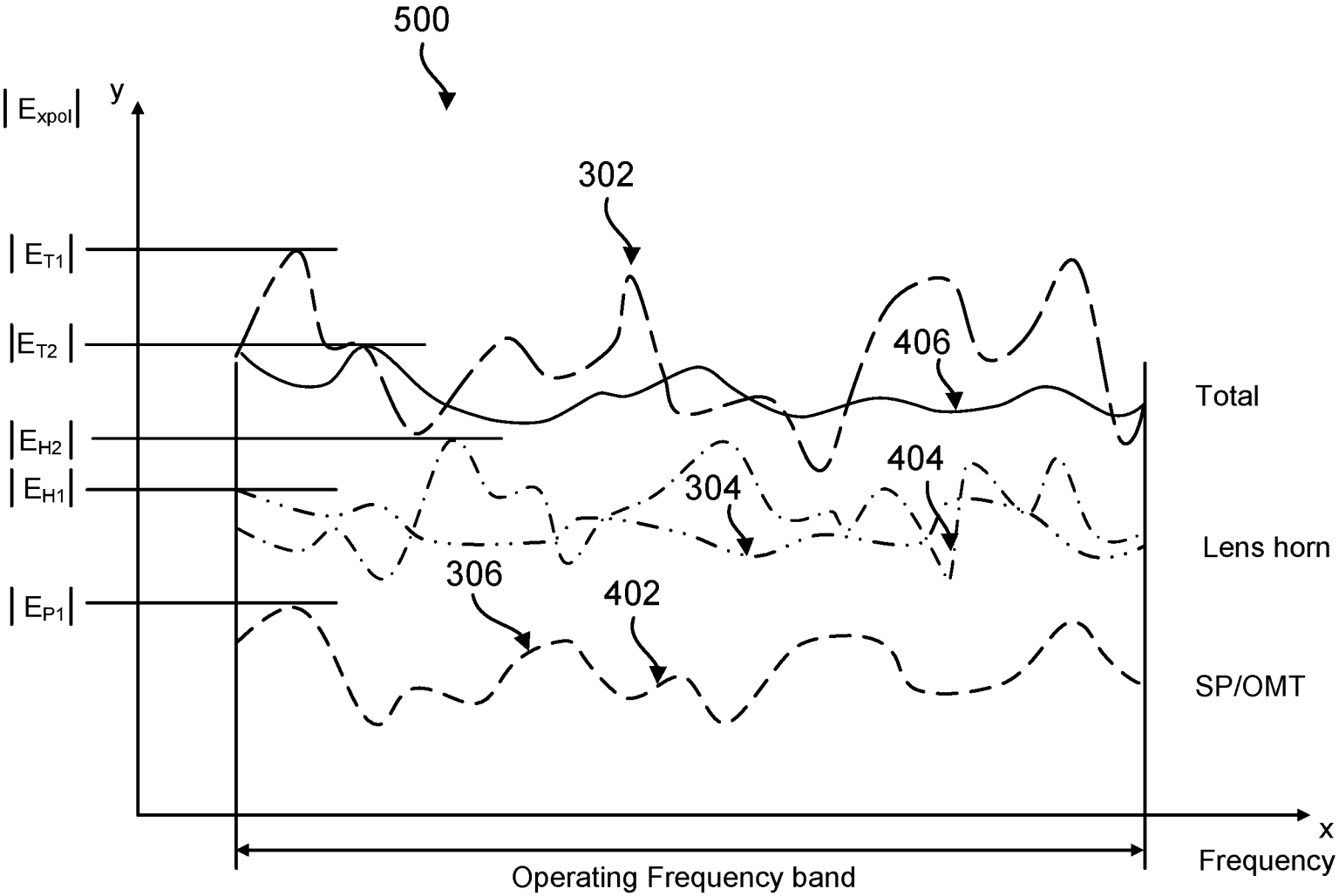
FIG. 5 is a diagram of the examples of FIGS. 3 and 4 overlaid together to illustrate the amplitude of cross-polarized radiation of a feed chain designed conventionally and the amplitude of cross-polarized radiation of a feed chain designed according to the systems and methods described herein.

FIG. 5 is a diagram of the examples of FIGS. 3 and 4 overlaid together to illustrate a plot of the amplitude of cross-polarized radiation of a feed chain designed conventionally overlaid on a plot of the amplitude of cross-polarized radiation of a feed chain designed according to the systems and methods described herein. In FIGS. 3 and 5, the total cross-polarized radiation 302 includes two contributions: the cross-polarized radiation of the polarizer (see dashed line 306) and the cross-polarized radiation of the feed horn (see dash-dotted line 304). The total cross-polarized radiation 302 of the feed chain results from the vector addition of the two contributions. As illustrated in FIGS. 4 and 5, the amplitude of cross-polarized radiation of a feed chain 100 may include the vector summation of the cross-polarized contribution from polarizer 104 (see dashed line 402) plus the cross-polarized contribution from the feed horn 102 (see dash-dot line 404). The total cross-polarized radiation of the feed chain 100 may also be represented by solid line (e.g., solid line 406).

As illustrated in FIG. 5, the improvement in cross-polarized radiation of the feed chain may be defined as the maximum amplitude of the total cross-polarized radiation ($|E_{T2}|$) represented by solid line 406 of the feed chain 100 being lower than the maximum amplitude of the total cross-polarized radiation ($|E_{T1}|$) represented by dashed line 302 of a feed chain designed conventionally ($|E_{T2}|<|E_{T1}|$).

Having the maximum amplitude of the total cross-polarized radiation (solid line 406) of the feed chain 100 be lower than the maximum amplitude of the total cross-polarized radiation (dashed line 302) of a feed chain designed conventionally may lead to improved performance of the feed chain 100, e.g., as compared to a feed chain designed conventionally. As described herein, generally, the cross-polarization performance of an antenna feed chain may impact the antennas performance. Accordingly, cross-polarization performance of an antenna feed chain may impact the performance of a communication system using the antenna. Thus, antenna performance may impact the ability of a communication to successfully send, successfully receive, or successfully send and receive signals. Accordingly, lowering total cross-polarized radiation may be beneficial to improve cross-polarization performance in an antenna feed chain. Accordingly, the feed chain 100 may perform better than a feed chain designed conventionally at least because the maximum amplitude of the total cross-polarization radiation of the feed chain 100 in a frequency band of interest may be lower than the maximum amplitude of the total cross-polarization radiation of the feed chain designed conventionally in the frequency band of interest.

As illustrated in FIG. 5, in accordance with another example embodiment, the improvement may be in that the total cross-polarized radiation of the feed chain 100, represented by solid line 406, is much "flatter" as compared to the total cross-polarized radiation 302 (dashed line) that may represent total cross-polarization radiation of a conventional feed chain. In an example embodiment, being flatter may be defined as a case when the amplitude of the cross-polarized radiation of the antenna feed chain has a lower standard deviation than the amplitude of the cross-polarization of an antenna feed chain that does not compensate for the cross-polarization of the polarizer. Stated another way, an absolute difference between the minimum amplitude and maximum amplitude of the total cross-polarized radiation for the antenna feed chain with compensation (ΔE for solid line 406) may be lower than that for a conventionally designed feed chain (ΔE for dashed line 302).

As illustrated in FIGS. 3-5, in an example embodiment, the performance of a first component, e.g., a polarizer, may have a certain variation. (See, for example, dashed lines 306, 402.) In the illustrated example of FIG. 3-5, the design of the polarizer may be fixed, as indicated by the single dashed line 306, 402. The performance of a second component, e.g., a horn, may have certain variations, depending on the particular design of the lens horn. (See, for example, lines 304, 404.) For example, the lens horn performance represented by dash-dotted line 304 may be designed to have a low cross-polarized radiation for the individual component, e.g., the lens horn alone may have a low cross-polarized radiation. In another example lens horn design, the lens horn may be designed to compensate for the polarizer. For example, areas of generally good performance of the second component may be selected or designed to correspond to areas of generally not as good performance by the first component. For example, in one embodiment, the best performance of the second component may correspond to the worst performance of the first component.

Additionally, as also illustrated in FIGS. 3-5, in an example embodiment, the cross-polarization radiation of the first component, e.g., a polarizer, may have a certain range of values over an operating frequency. (See, for example, dashed lines 306, 402.) As discussed above, the design of the polarizer may be fixed. The cross-polarization radiation of the second component, e.g., a horn, may have a certain range of values, depending on the particular design of the horn. (See, for example, lines 304, 404.) For example, as discussed above, the lens horn performance represented by dash-dotted line 304 may be designed to have a low cross-polarized radiation for the individual component, e.g., the lens horn alone. In another example lens horn design, the lens horn may be designed to compensate for the polarizer. Accordingly, because of the compensation, e.g., areas of generally good performance selected to correspond to areas of generally not as good performance, the range of values of the total (solid line 406) may have a much lower range of values as compared to the range of values of the total (dashed line 302). For example, an absolute difference between the minimum amplitude and maximum amplitude of the total cross-polarized radiation for the antenna feed chain with compensation (ΔE for solid line 406) may be lower than that for a conventionally designed feed chain (ΔE for dashed line 302).

As described with respect to the example of FIGS. 3-5, the polarizer may be fixed and the lens horn may vary. It will be understood that in another example, the lens horn may be fixed and the polarizer may vary. Furthermore, in some examples, the design may be iterative. For example, initially, the polarizer may be fixed and the lens horn may be varied. Then, the updated lens horn may be fixed and the polarizer may be varied. The iterations may be performed a number of times.

Figure 6:
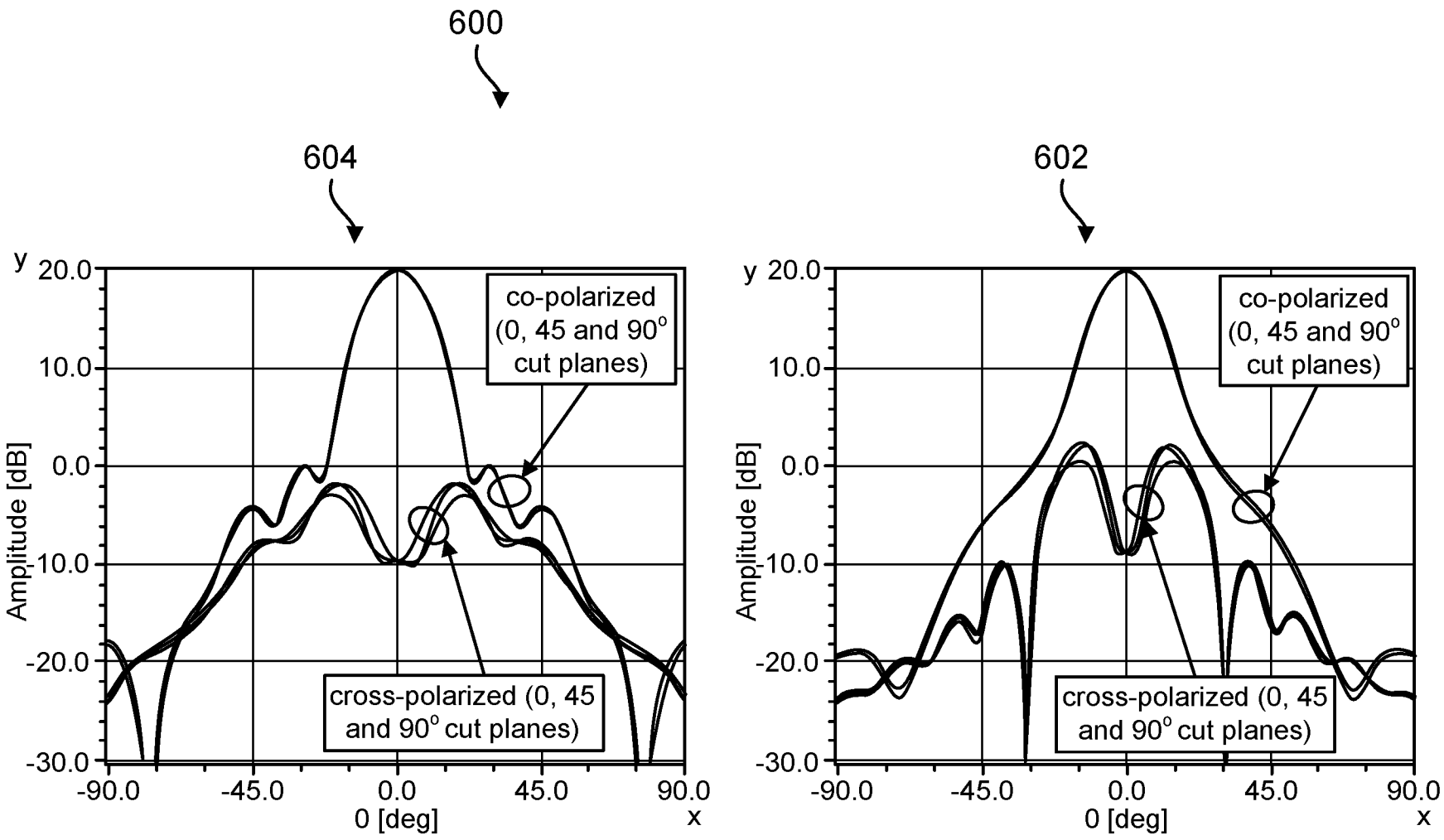
FIG. 6 is a diagram illustrating an example of receive performance of a feed chain designed as described herein as compared to a feed chain designed a conventional way.

FIG. 6 is a diagram 600 illustrating an example of receive performance of a feed chain designed as described herein as compared to a feed chain designed a conventional way. FIG. 6 includes typical receive-band far-field gain radiation patterns. The diagram 600 includes receive plots of amplitude in dB for examples of both conventional feed chain designs 602 and designs according to the systems and methods described herein 604 over spatial angles from −90.0 degrees to +90.0 degrees. The amplitude is along the y-axis and the angles measured from the feed chain boresight are along the x-axis. As illustrated in FIG. 6, the receive plots feature lower cross-polarized radiation for a feed chain designed according to the systems and methods described herein as compared to conventional designs.

Figure 7:
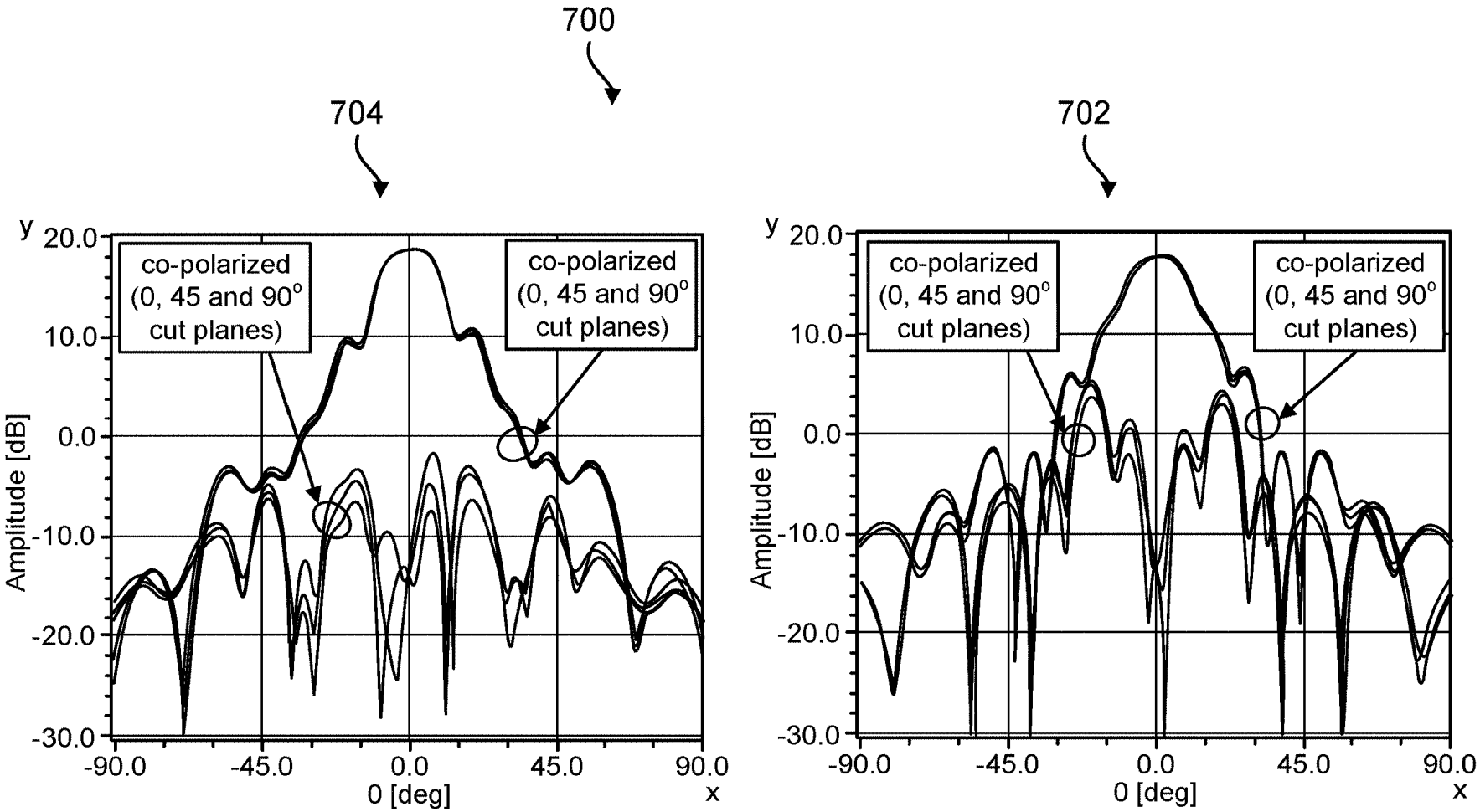
FIG. 7 is a diagram illustrating an example of transmit performance of a feed chain designed as described herein as compared to a feed chain designed a conventional way.

FIG. 7 is a diagram 700 illustrating an example of transmit performance of a feed chain 704 designed as described herein as compared to a feed chain 702 designed a conventional way. FIG. 7 includes typical transmit-band far-field gain radiation patterns. The diagram 700 includes transmit plots of amplitude in dB for examples of both conventional feed chain designs and designs according to the systems and methods described herein over spatial angles from −90.0 degrees to +90.0 degrees. The amplitude is along the y-axis and the angles measured from the feed chain boresight are along the x-axis. As illustrated in FIG. 7, the transmit plots feature lower cross-polarized radiation for a feed chain designed according to the systems and methods described herein as compared to conventional designs.

Figure 8:
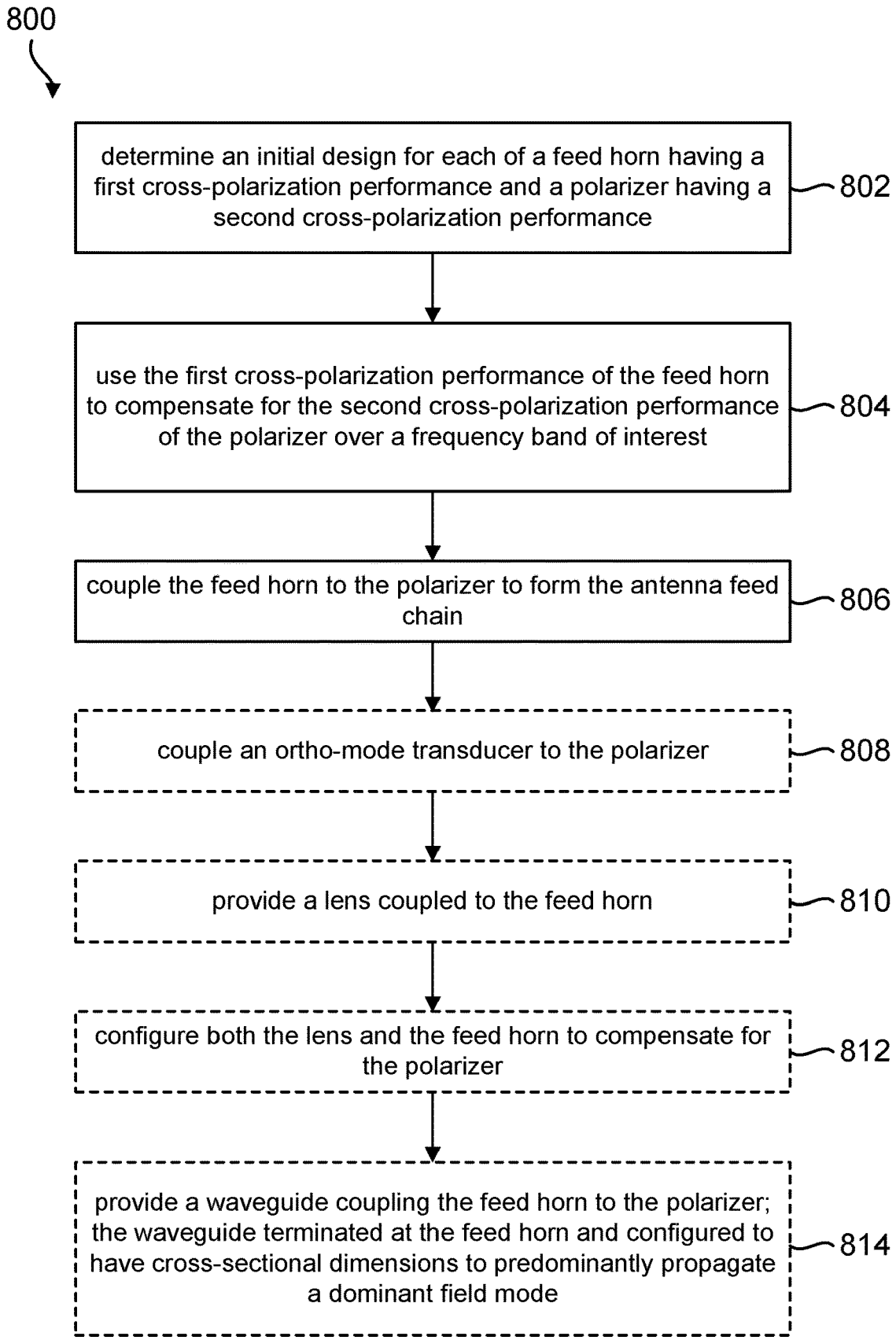
FIG. 8 is a flow chart for an example method disclosed herein.

FIG. 8 is a flow chart for an example method 800 disclosed herein. The example method 800 is a method of designing an antenna feed chain. The method includes determining an initial design for each of a feed horn having a first cross-polarization performance and a polarizer having a second cross-polarization performance (802). For example, an initial design may attempt to optimize or select adequate design parameters for both the feed horn and the polarizer. Optimizing or selecting adequate design parameters for the individual feed horn and polarizer may each be based on maximizing or increasing some indication of performance for the design of the individual component (such as cross-polarization performance as described herein). However, the systems and methods described herein may also be applied to one or more indication of performance discussed herein, or generally to other indications of performance of an antenna system.

The method 800 may further include using the first cross-polarization performance of the feed horn to compensate for the second cross-polarization performance of the polarizer over a solid angle of interest and a frequency band of interest (804). For example, the feed horn 102 may be optimized in the full feed chain (antenna feed chain 100 of FIG. 1). This may involve deviating from the initial design of the feed horn. Thus, in the initial design, the feed horn 102 may have a first cross-polarization performance over a solid angle of interest and a frequency band of interest. But the subsequent design may result in the feed horn having a second cross-polarization performance over the solid angle of interest and the frequency band of interest. The new, second, cross-polarization performance of the feed horn may compensate for a cross-polarization performance of the polarizer over the frequency band of interest. Stated another way, the subsequent design may degrade the cross-polarization performance characteristic of the feed horn from that of the initial design, standing alone, but at the same time improve the cross-polarization performance characteristic of the antenna feed chain.

As described herein, using the first cross-polarization performance of the feed horn to compensate for the second cross-polarization performance of the polarizer over a frequency band of interest may include using the cross-polarization performance of the polarizer to compensate for the cross-polarization performance of the feed horn over a solid angle of interest and a frequency band of interest. For example, an initial design of one or more of the feed-horn or the polarizer may be modified improve the performance of the combination of the feed horn and the polarizer coupled together. As used herein, optimize generally refers to improving the design of a component (e.g., the feed horn or the polarizer) or a group of components (e.g., the feed horn coupled to the polarizer) based on some improvement of one or more selected indicators of performance for the particular component (e.g., the feed horn or the polarizer) or group of components (e.g., the feed horn and the polarizer coupled together). Optimizing does not necessarily mean creating the best possible design, but rather, refers to increasing relative performance of the design using the systems and methods described herein. The systems and methods described herein may also be applied to one or more indication of performance discussed herein, or generally to other indications of performance of an antenna system.

The method 800 further includes coupling the feed horn to the polarizer to form the antenna feed chain (806). In an example embodiment, the first cross-polarization performance of the feed horn and the second cross-polarization performance of the polarizer are such that the feed horn and the polarizer cooperate in providing improved cross-polarization performance of the antenna feed chain when the polarizer is coupled to the feed horn. The improved cross-polarization performance is relative to an antenna feed chain having a feed horn that has not been configured to compensate for the polarizer over the frequency band of interest. Generally, an improvement (as determined by a selected indicator of performance) of the combined components when coupled together is the goal of the systems and methods described herein.

In an example embodiment, method 800 may include coupling an ortho-mode transducer to the polarizer (step 808). Accordingly, the systems and methods described herein may be applied to a polarizer, e.g., coupled to a lens horn.

In an example embodiment, the maximal amplitude of cross-polarized radiation of the antenna feed chain within the solid angle of interest and over the frequency band of interest is smaller based on the feed horn being configured to compensate for the cross-polarization of the polarizer than the maximum amplitude of cross-polarized radiation of the antenna feed chain that does not have the feed horn configured to compensate for the cross-polarization of the polarizer.

In an example embodiment, an amplitude of cross-polarized radiation of the antenna feed chain, within the solid angle of interest and over the frequency band of interest, is flatter within the solid angle of interest and over the frequency band of interest, based on the feed horn being configured to compensate for the cross-polarization of the polarizer than the amplitude of cross-polarized radiation of the antenna feed chain that does not have the feed horn configured to compensate for the cross-polarization of the polarizer.

In an example embodiment, an amplitude of cross-polarized radiation of the antenna feed chain being flatter comprises the amplitude of the cross-polarized radiation of the antenna feed chain having a lower standard deviation than the amplitude of the cross-polarization of an antenna feed chain that does not compensate for the cross-polarization of the polarizer.

In an example embodiment, method 800 further includes providing a lens coupled to the feed horn (step 810) and configuring both the lens and the feed horn to compensate for the cross-polarization of the polarizer (step 812). As described herein, in the systems and methods described, a lens may be used to improve the design.

In an example embodiment, the first cross-polarization performance of the feed horn 102 and the second cross-polarization performance of the polarizer 104 are such that the feed horn 102 and the polarizer 104 cooperate in providing an increase in cross-polarization performance when the polarizer 104 is coupled to the feed horn 102.

In one example embodiment polarizer 104 is an SP/OMT. In another example embodiment, the polarizer may be a combination of a separate ortho-mode transducer coupled to the polarizer.

In an example embodiment, the maximum amplitude of cross-polarized radiation of the antenna feed chain 100 is lower within the solid angle of interest and over the frequency band of interest, based on the feed horn 102 being configured to compensate for the cross-polarization of the polarizer than the maximum amplitude of cross-polarized radiation of an antenna feed chain that does not have the feed horn configured to compensate for the cross-polarization of the polarizer. (See FIGS. 4 and 5.)

In an example embodiment, an antenna feed chain, comprises: a feed horn; and a polarizer coupled to the feed horn, the feed horn having a cross-polarization performance over an angle of interest and a frequency band of interest (XP performance) that is worse than a reference feed horn XP performance of a reference feed horn (of the same kind, aperture diameter, and length as the feed horn). In this example embodiment, the antenna feed chain nonetheless has a XP performance that is better than a reference antenna feed chain XP performance of a reference antenna feed chain comprising the reference feed horn and the polarizer. In an example embodiment, worse means that the maximum amplitude of the feedhorn cross-polarized radiation ($|E_{H2}|$) of the antenna feed chain, over the solid angle of interest and the frequency band of interest, is higher than a maximum amplitude of the feedhorn cross-polarized radiation ($|E_{H1}|$) of a non-compensated antenna feed chain, over the solid angle of interest and the frequency band of interest, ($|E_{H2}|<|E_{H1}|$). In an example embodiment, better means that the maximum amplitude of the total cross-polarized radiation ($|E_{T2}|$) of the antenna feed chain, over the solid angle of interest and the frequency band of interest, is lower than a maximum amplitude of the total cross-polarized radiation ($|E_{T1}|$) of a non-compensated antenna feed chain, over the solid angle of interest and the frequency band of interest, ($|E_{T2}|<|E_{T1}|$).

In describing the present invention, the following terminology will be used: The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes, and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including, for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

It should be appreciated that the particular implementations shown and described herein are illustrative of the invention and its best mode and are not intended to otherwise limit the scope of the present invention in any way. Furthermore, the connecting lines shown in the various figures contained herein are intended to represent exemplary functional relationships and/or physical couplings between the various elements. It should be noted that many alternative or additional functional relationships or physical connections may be present in a practical device.

As one skilled in the art will appreciate, the mechanism of the present invention may be suitably configured in any of several ways. It should be understood that the mechanism described herein with reference to the figures is but one exemplary embodiment of the invention and is not intended to limit the scope of the invention as described above.

It should be understood, however, that the detailed description and specific examples, while indicating exemplary embodiments of the present invention, are given for purposes of illustration only and not of limitation. Many changes and modifications within the scope of the instant invention may be made without departing from the spirit thereof, and the invention includes all such modifications. The corresponding structures, materials, acts, and equivalents of all elements in the claims below are intended to include any structure, material, or acts for performing the functions in combination with other claimed elements as specifically claimed. The scope of the invention should be determined by the appended claims and their legal equivalents, rather than by the examples given above. For example, the operations recited in any method claims may be executed in any order and are not limited to the order presented in the claims. Moreover, no element is essential to the practice of the invention unless specifically described herein as "critical" or "essential."

What is claimed is:

1. An antenna feed chain, comprising:

a lens horn comprising a rotationally symmetric feed horn and a lens coupled to the feed horn, the lens horn having a first cross-polarization performance over a solid angle of interest and a frequency band of interest; and a polarizer having a second cross-polarization performance over the frequency band of interest, the polarizer coupled to the feed horn, wherein the first cross-polarization performance of the lens horn compensates for the second cross-polarization performance of the polarizer over the solid angle of interest and the frequency band of interest; and wherein the compensation is due at least in part to at least one of: (i) surface shapes of the lens; or (ii) a position of the lens relative to the feed horn.

2. The antenna feed chain of claim 1, wherein the first cross-polarization performance of the lens horn and the second cross-polarization performance of the polarizer are such that the lens horn and the polarizer cooperate to provide an increase in cross-polarization performance when the polarizer is coupled to the feed horn.

3. The antenna feed chain of claim 1, wherein a maximum amplitude of the total cross-polarized radiation ($|E_{T2}|$) of the antenna feed chain, over the solid angle of interest and the frequency band of interest, is lower than a maximum amplitude of the total cross-polarized radiation ($|E_{T1}|$) of a non-compensated antenna feed chain, over the solid angle of interest and the frequency band of interest, ($|E_{T2}|<|E_{T1}|$).

4. The antenna feed chain of claim 3, wherein a maximal amplitude of cross-polarized radiation of the antenna feed chain within the solid angle of interest and over the frequency band of interest is smaller based on the lens horn being configured to compensate for the polarizer than the cross-polarized radiation of the antenna feed chain that does not have the lens horn configured to compensate.

5. The antenna feed chain of claim 3, wherein an amplitude of cross-polarized radiation of the antenna feed chain is flatter within the solid angle of interest and over the frequency band of interest based on the lens horn being configured to compensate for the polarizer than the cross-polarized radiation of the antenna feed chain that does not have the lens horn configured to compensate.

6. The antenna feed chain of claim 5, wherein an amplitude of the cross-polarized radiation of the antenna feed chain being flatter comprises the amplitude of the cross-polarized radiation of the antenna feed chain having a lower standard deviation than without compensation.

7. The antenna feed chain of claim 1, wherein the feed horn comprises at least one of a smoothly flared horn, a discontinuous flared horn, or a combination of the smoothly flared horn and the discontinuous flared horn.

8. The antenna feed chain of claim 1, further comprising a waveguide coupling the feed horn to the polarizer, the waveguide terminated at the feed horn and configured to have cross-sectional dimensions to predominantly propagate a dominant field mode.

9. The antenna feed chain of claim 1, further comprising a reflector configured to reflect signals from the lens horn.

10. The antenna feed chain of claim 1, wherein the polarizer comprises a septum polarizer ortho-mode transducer.

11. A method of designing an antenna feed chain that includes a polarizer coupled to a lens horn, the lens horn having, a feed horn coupled to a lens, the method comprising:

determining initial designs for the lens horn and the polarizer, the initial design for the lens horn yielding a first cross-polarization performance for the lens horn over a predetermined frequency band, the initial design for theft polarizer yielding a second cross-polarization performance for the polarizer over the frequency band, and the initial designs of the lens horn and the polarizer yielding a total cross-polarization performance for the antenna feed chain over the frequency band; and adjusting the design of the lens horn in a manner modifying the first cross-polarization performance of the lens horn to compensate for the second cross-polarization performance of the polarizer, wherein the compensation is at least partially due to surface shapes of the lens and/or a position of the lens relative to the feed horn, and the compensation causes at least one of (i) reducing a maximum cross-polarization of the total cross-polarization performance over the frequency band; or (ii) reducing a range of cross-polarization of the total cross-polarization performance over the frequency band.

12. The method of claim 11, wherein the compensation causes the reduction of the maximum cross-polarization of the total cross-polarization performance over the frequency band.

13. The method of claim 11, wherein the antenna feed chain further comprising an ortho-mode transducer coupled to the polarizer.

14. The method of claim 13, wherein the compensation causes the reduction in the range of cross-polarization of the total cross-polarization performance over the frequency band.

15. The method of claim 14, wherein the reduction in the range of cross-polarization corresponds to amplitude of the cross-polarization having a lower standard deviation than without compensation.

16. The method of claim 11, wherein the feed horn comprises at least one of a smoothly flared horn, a discontinuous flared horn, or a combination of the smoothly flared horn and the discontinuous flared horn.

17. The method of claim 11, wherein the antenna feed chain further comprises a waveguide coupling the feed horn to the polarizer, the waveguide terminated at the feed horn and configured to have cross-sectional dimensions to predominantly propagate a dominant field mode.

18. The method of claim 11, wherein the polarizer comprises a septum polarizer ortho-mode transducer.

* * * * *